US006791474B2

(12) United States Patent
Lenz et al.

(10) Patent No.: US 6,791,474 B2
(45) Date of Patent: Sep. 14, 2004

(54) MAGNETIC CHECKPOINT

(75) Inventors: James E. Lenz, Brooklyn Park, MN (US); Erick C. Nehls, III, Scottsdale, AZ (US); Howard B. French, Falcon Heights, MN (US); Gordon F. Rouse, Arden Hills, MN (US)

(73) Assignee: Honeywell International Inc., Morristown, NJ (US)

( * ) Notice: Subject to any disclaimer, the term of this patent is extended or adjusted under 35 U.S.C. 154(b) by 145 days.

(21) Appl. No.: 09/945,494

(22) Filed: Aug. 30, 2001

(65) Prior Publication Data

US 2003/0210158 A1 Nov. 13, 2003

(51) Int. Cl.[7] ..... G08G 1/01

(52) U.S. Cl. ..... 340/933; 340/941; 340/988; 340/989; 340/990; 340/993

(58) Field of Search ..... 340/933, 941, 340/988, 989, 990, 993

(56) References Cited

U.S. PATENT DOCUMENTS

| | | | | |
|---|---|---|---|---|
| 4,122,522 A | | 10/1978 | Smith | |
| 4,845,629 A | | 7/1989 | Murga | |
| 5,027,114 A | | 6/1991 | Kawashima et al. | |
| 5,321,615 A | | 6/1994 | Frisbie et al. | |
| 5,485,151 A | | 1/1996 | Runyon et al. | |
| 5,508,697 A | | 4/1996 | Kato et al. | |
| 5,548,515 A | | 8/1996 | Pilley et al. | |
| 5,689,184 A | * | 11/1997 | Jeffers et al. | 324/243 |
| 5,883,587 A | * | 3/1999 | Ikemoto | 340/988 |
| 5,969,642 A | | 10/1999 | Runyon et al. | |
| 5,983,161 A | | 11/1999 | Lemelson et al. | |
| 6,006,158 A | | 12/1999 | Pilley et al. | |
| 6,084,533 A | | 7/2000 | Morgan et al. | |
| 6,182,005 B1 | | 1/2001 | Pilley et al. | |
| 6,195,020 B1 | | 2/2001 | Brodeur, Sr. et al. | |
| 6,195,609 B1 | | 2/2001 | Pilley et al. | |
| 6,208,268 B1 | * | 3/2001 | Scarzello et al. | 340/941 |
| 6,253,064 B1 | | 6/2001 | Monroe | |
| 6,462,697 B1 | * | 10/2002 | Klamer et al. | 342/36 |

FOREIGN PATENT DOCUMENTS

| | | |
|---|---|---|
| WO | WO 95/28693 | 10/1995 |
| WO | WO 99/35630 | 7/1999 |
| WO | WO 01/39155 | 5/2001 |

* cited by examiner

*Primary Examiner*—Daryl Pope

(57) ABSTRACT

A vehicle detecting system and method for use on a specific location such as an airport, including a sensor string nominally perpendicular to the direction of vehicle travel at the location. The sensor string includes at least one magnetic field sensor and a transmitter for transmitting signals from the at least one sensor to a monitoring point. A plurality of sensors is preferred. The transmitter includes a control unit for receiving the signals and a sender for sending the signals to the monitoring point. The preferred magnetic field sensor is a magnetoresisteive sensor having a field range of at least ±5 gauss. A preferred location for the sensor string is in a groove in the surface.

14 Claims, 3 Drawing Sheets

MAGNETIC CHECKPOINT

FIELD OF THE INVENTION

The present invention relates to sensor system for use at airports and the like. More particularly the invention relates to a magnetic sensor and signal processing system to provide reliable detection of vehicles at specific locations on an area such as an airport.

BACKGROUND OF THE INVENTION

The presence of vehicles on airport surfaces is currently being monitored visually and by radio contact with various air traffic controllers and others such as baggage handling operations. As air transportation has increased in traffic at major domestic airports, the number and types of vehicles, both aircraft and ground vehicles, has increased rapidly and requires extreme vigilance. Relying on human observation and reporting, however, leaves open the possibility of an aircraft, fuel truck, baggage tractor or other vehicles being in the wrong place at the wrong time.

Concern at major airports where many vehicles and a high potential population density on the runways has been sufficient for extremely costly and complicated systems to be devised to monitor runway traffic. However, at smaller airports, the cost of such as system is prohibitive, leaving the safety of the runways to visual observation exclusively. Even with less traffic, there is still a risk due to fewer personnel being employed to monitor the runways.

Several prior art efforts have been made to improve airport monitoring. Smith U.S. Pat. No. 4,122,522 discloses an aircraft ground monitoring system used when aircraft are taking off or landing, and involves a very complicated design taking into account actual and predicted velocity and the like. Kawashima et. al. U.S. Pat. No. 5,027,114 discloses a ground guidance system using loop coils buried in portions of a taxi way for aircraft. A change in self-inductance of the loop coils provides a signal indicating the presence or absence of an airplane, while also including a fail-safe structure. The loop coils are described on column 2, beginning at line 25, as having the side parallel to the traffic is longer than an automobile but smaller than the aircraft length. The sensor coils overlap for continuous monitoring of a given aircraft, in part to eliminate the activation by an automobile that is too short to be in two coils. Kawashima uses complicated circuitry processing data from sensors that discriminate between cars and planes.

Pilley et. al. U.S. Pat. No. 6,182,005, (and its related U.S. Pat. Nos. 5,548,515; 6,006,158; and 6,195,609) represent a very exhaustively complicated airport guidance and safety system, and uses a variety of means for locating and guiding aircraft and vehicles such as trucks and the like. Pilley et. al. does not attempt to monitor the presence or absence of any vehicle at given locations. Pilley et. al does require each vehicle to have the capability to transmit a minimum of several signals.

Murga U.S. Pat. No. 4,845,629 discloses the use of infra-red, telemetric sensors. Runyon et al. U.S. Pat. Nos. 5,485,151 and 5,969,642 disclose the use of microwave transmitters and receivers as presence detectors. Kato et al. U.S. Pat. No. 5,508,697 also transmits electromagnetic waves that are interrupted by the presence of an aircraft. Brodeur et al. U.S. Pat. No. 6,195,020 discloses the use of magnetometer sensors at railroad crossings.

It would be of great advantage in the art if a simple and effective system could be devised that would indicate the presence of a vehicle at a specific location on the airport surface.

It would be another advantage in the art if such information could be easily transmitted to the control tower even when the location is in a tower or ground radar blind spot.

Other advantages will appear hereinafter.

SUMMARY OF THE INVENTION

It has now been discovered that the above and other objects of the present invention may be accomplished in the following manner. Specifically, the present invention provides a vehicle detecting system for use on a specific location such as an airport. The system includes a sensor string crossing the path of travel at the location, preferably perpendicular to that direction of travel. The string includes at least one magnetic field sensor and preferably a plurality sufficient to provide magnetic field detection across the location to give complete and even overlapping coverage. Also provided is a transmitter for transmitting signals from the at least one sensor to a monitoring point.

The transmitter can employ a control unit for receiving the signals and a sender for sending the signals to the monitoring point. The preferred magnetic field sensor is a magnetoresistive sensor, and most preferred is a three-axis magnetoresistive sensor having a field range of at least ±5 gauss.

In most applications, the sensor string is operably positioned in a groove in the surface so as to avoid wear and tear on the sensor string and, to a lesser extent, the vehicles passing through the location. The monitoring point normally will include a display and control system.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
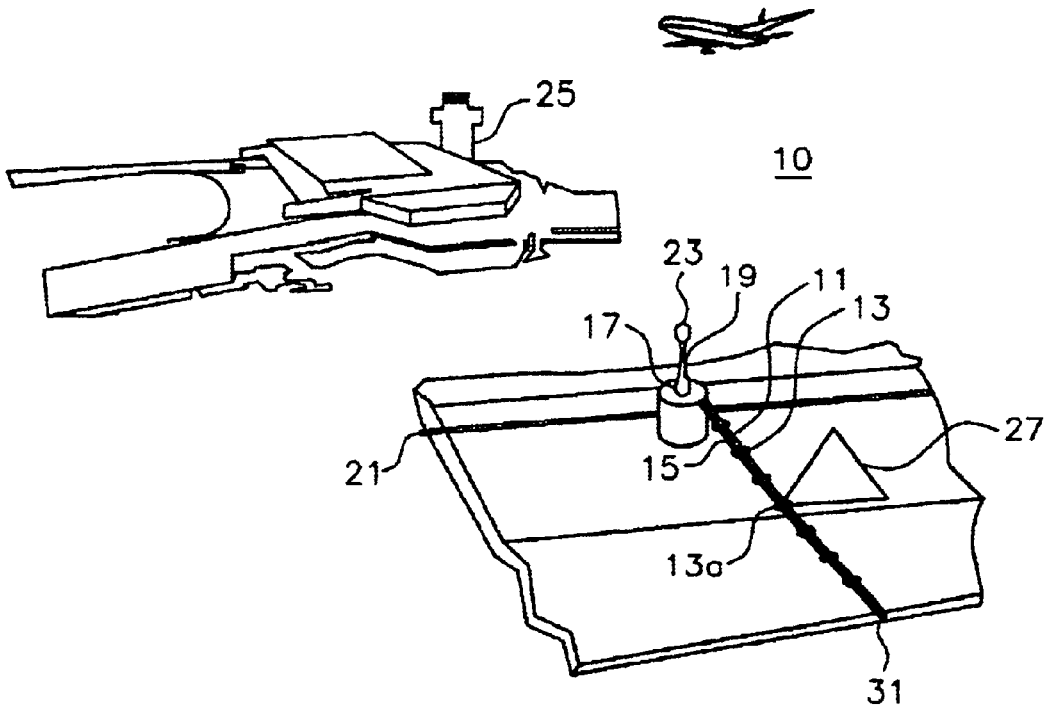
FIG. 1 is a schematic view illustrating the general location of the invention on an airport runway.

As shown in the drawings, the present invention provides a low cost, point presence sensor designed to indicate whether or not a vehicle is present at a single location. It is contemplated that an airport would have a large plurality of these systems, each independently relaying information to a coordinating location, where single inputs or a plurality of inputs could be used to monitor a variety of conditions at the location.

As shown in FIG. 1, the present invention shown generally by reference 10 includes a sensor string 11 which includes a plurality of sensors 13 strung together on cable 15 and connected to control box 17, shown here located in a light fixture 19 to provide electrical power from power line 21 to power the system. The control box 17 receives signals from the sensors 13, and transmits them, in this embodiment by a RF transmission terminal 23, to the control tower 25. In FIG. 1, the magnetic field 27 illustrates the area where one specific sensor 13*a* is in operation.

In FIG. 1, the string is placed in a kerf cut 31, shown as 0.5 inches wide. Alternative ways of placing the string include piping, tubing, and protective shields.

Figure 2:
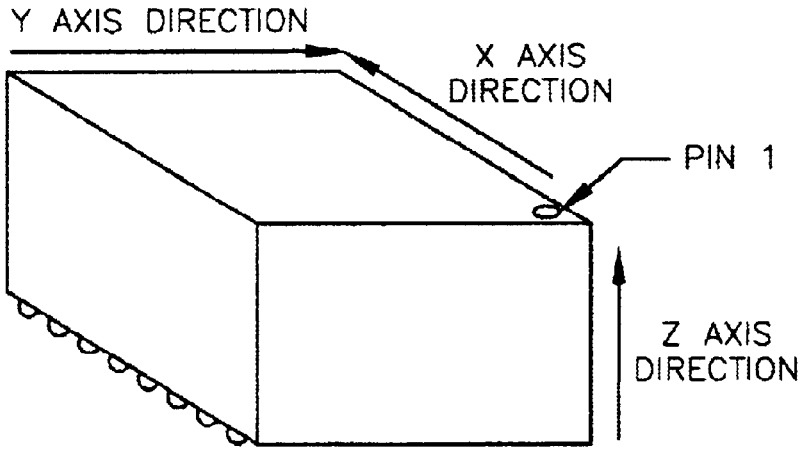
FIG. 2 is a perspective view of the sensor device used in the present invention.

It is preferred that the sensors 13 have a field range of at least ±5 gauss. In the preferred embodiment, sensors 13 comprise a number of magnetic field sensors such as the HMC 1023 Three-Axis Magnetoresistive Sensor, available from Honeywell International, Inc. FIG. 2 illustrates the sensor 13 in perspective, showing the locations of the x, y and z axes. This model has a field range of ±6 gauss (earth's field is 0.5 gauss) while maintaining high sensitivity with a minimal detectable field down to 85 $\mu$gauss. The sensor operates as a single stand alone three-axis magnetoresistive sensor. A Custom Ball Grid Array, 1 mm pitch, 16-pin miniature package provides a small footprint and accurate sensor placement for orthogonal three-axis sensing. This sensor can be operated with a 3 to 25 volt supply.

Of course other magnetic sensors with similar sensitiviy, size, and power features can be used as well. All that is required is that the sensor be sized to fit in an array of sensors across a portion of the property being monitored, and be able to detect the presence of objects such as vehicles in the region being monitored. Sensor spacing is determined by the specific sensor and the length of the area monitored, so that it will reliably detect any vehicle passing over it without generating false alarms.

The control box 17 provides system power and performs the processing and communications functions. Power is provided by a battery inside control box 17 that is charged from the lighting circuit 21, although other power sources such as solar panels would function as well, once properly installed. The processor in the control box combines the signals from all of the sensors in the string to determine whether a vehicle is present. A preferred processor is a 16-bit microprocessor with 1 megabyte of memory. An 8-bit processor with built-in analog to digital conversion is preferred with each magnetic sensor 13. The resulting presence/absence status is transmitted to the tower 25 through a low data rate RF link 23.

A significant feature of this invention is the use of a string of multi-axis sensors to reduce the signal processing complexity. The multitude of low cost sensors allows for each sensor to have a simple detection threshold and the pattern of detection as the object passes over the string builds a high confidence in the detection and elimination of false alarms.

It is contemplated that additional data processing would make it possible to provide information concerning vehicle speed and type, such as distinguishing between ground vehicles and aircraft, and even distinguishing between types of aircraft, such as 727s versus DC9s.

The operator interface in the tower 25 can take a variety of forms, depending on the needs of the situation, such as for example a major airport or a small air field. It is preferred that the RF signal will be input to a comprehensive ground traffic signal system, such as Surveillance Server (MSDP) from Sensis, Inc. Other possibilities include an aural alarm or an indicator light, either standing alone or at the proper location on an airport map, for example. The direct operator interface for any system could be turned off at times when the location is not of interest, for example when a particular runway is not in use. This would reduce the demands on the controllers' attention.

It should also be noted that all of the components of the present invention function over the full range of temperatures and other weather conditions at airports. Rain, fog, snow and the like have no effect on the magnetic sensing function. The sensor 13, being located at a single point, is not affected by terrain surrounding the airport.

Figure 3A:
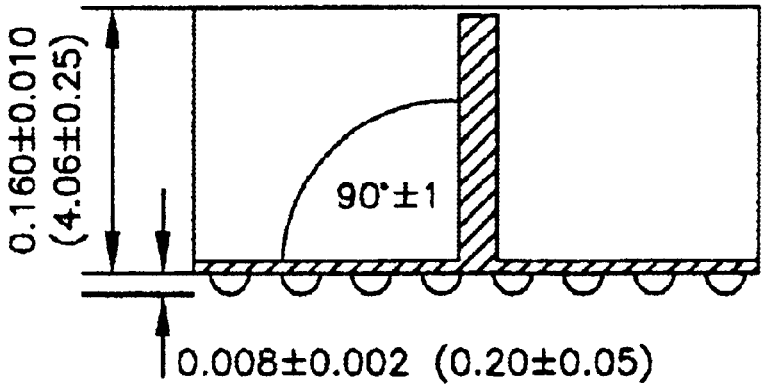
FIGS. 3*a* and 3*b* are side and bottom views of the sensor of FIG. 2, respectively.
Figure 3B:
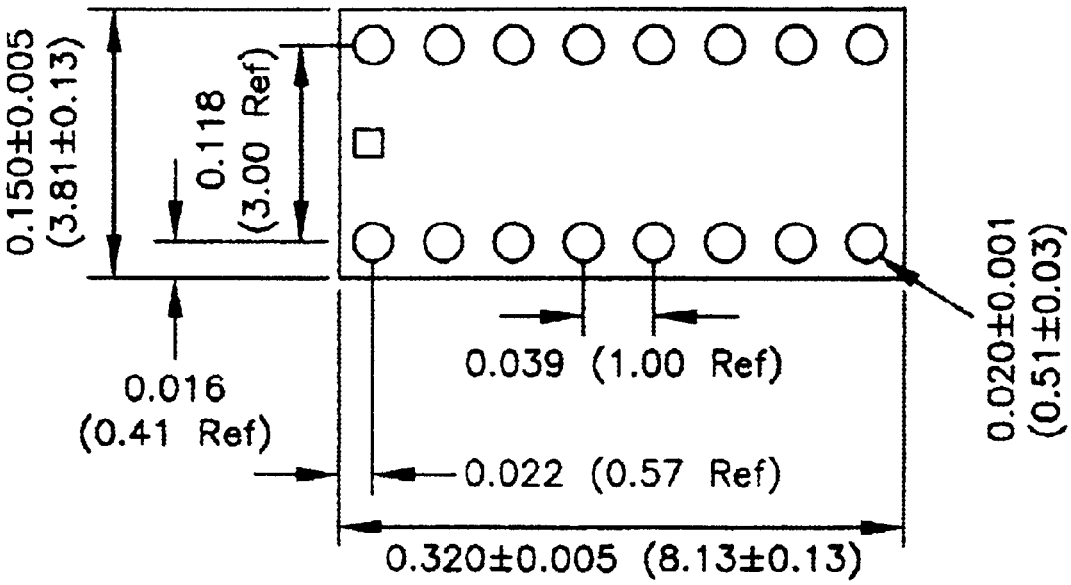
Figure 4:
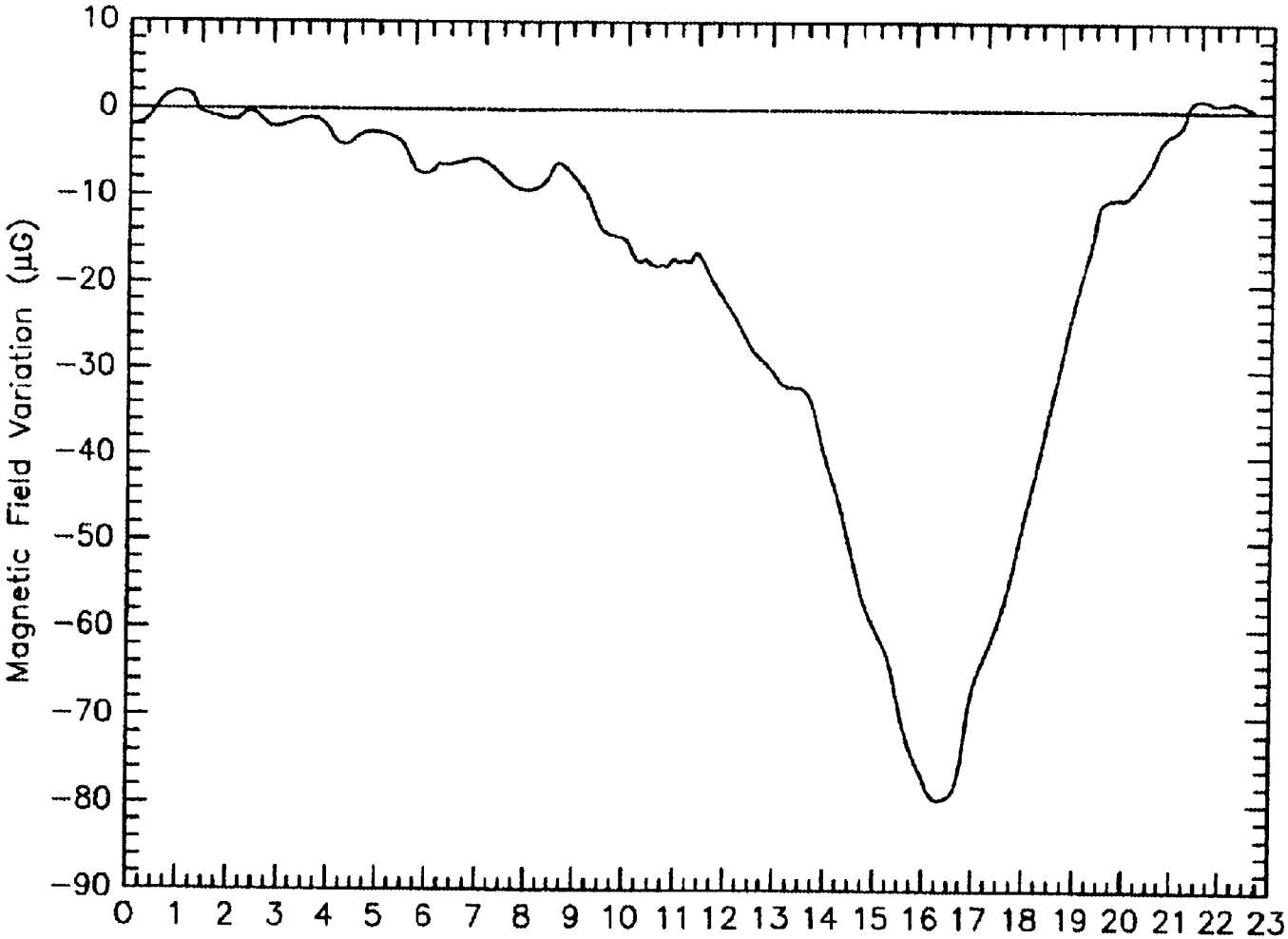
FIG. 4 is a graph illustrating the results of one test showing the efficacy of the present invention.

In order to demonstrate the efficacy of the present invention, an installation similar to FIG. 1 was deployed. FIG. 3 shows the measured response of a surface-mounted, vertically oriented magnetic sensor to a Cessna 152 aircraft passing at a distance of about ten feet. Because an algorithm to detect with a string of sensors becomes a discrete detection thresholding method, rather than a real-time processing of low signal-to-noise ratios, cost are reduced compared to time series data for inductive loops.

The advantages of the present invention are many. Hot spot surveillance is now available to provide high integrity detection of aircraft entering the hot spot to draw controller attention if the entry is unexpected. Remote spot surveillance is now possible, giving high integrity detection of aircraft entering the remote or visually-obscured area to draw controller attention, again if there is entry at that location. The device may be used in areas shielded from ground radar and areas subject to ghost images, which information is otherwise unavailable or unreliable. Of course the present invention is extremely useful at airports without ground radar. In addition, the present invention is useful in push-back detection, to alert a controller to aircraft beginning push-back, as well as to pushed-back aircraft blocking inner taxiways.

While particular embodiments of the present invention have been illustrated and described, it is not intended to limit the invention, except as defined by the following claims.

What is claimed is:

1. A vehicle detecting system for use on a specific location, comprising:

a sensor string positioned at the location to engage a direction of travel on said location, said sensor string including a plurality of three-axis magnetoresistive sensors positioned perpendicular to said direction of travel and having a field range of at least ±5 gauss for detecting the presence of a vehicle in said location, said plurality of sensors having overlapping areas of detection; and a transmitter for separate transmitting signals from said plurality of sensors to a monitoring point.

2. The system of claim 1, wherein said specific location is an airport.

3. The system of claim 1, wherein said transmitter includes a control unit for receiving said signals and a sender for sending said signals to said monitoring point.

4. The system of claim 1, wherein said sensor string is operably positioned in a groove in said surface.

5. The system of claim 1, wherein said sensor string is operably positioned in a pipe in said surface.

6. A vehicle detecting system for use on a specific location, comprising:

sensor means positioned at the location to engage a direction of travel on said location, said sensor means including a plurality of three-axis magnetoresistive sensors positioned perpendicular to said direction of travel and having a field range of at least ±5 gauss for detecting the presence of a vehicle in said location, said plurality of sensors having overlapping areas of detection; and transmitter means for transmitting separate signals from said plurality of sensor means to a monitoring point.

7. The system of claim 6, wherein said specific location is an airport.

8. The system of claim 6, wherein said transmitter means includes a control unit means for receiving said signals and a sender means for sending said signals to said monitoring point.

9. The system of claim 6, wherein said sensor means is operably positioned in a groove in said surface.

10. The system of claim 6, wherein said sensor string is operably positioned in a pipe in said surface.

11. A method for monitoring the presence or absence of a vehicle at a specific location, comprising the steps of:

positioning a sensor string at the location to engage a direction of travel on said location, said sensor string including a plurality of three-axis magnetoresistive sensors positioned perpendicular to said direction of travel and having a field range of at least ±5 gauss for detecting the presence of a vehicle in said location, said plurality of sensors having overlapping areas of detection; and transmitting separate signals from said plurality of sensors to a monitoring point.

12. The method of claim 11, which further includes transmitting said signal to a control unit adapted to receive said signals and send said signals to said monitoring point.

13. The method of claim 11, which includes the step of operably positioning said sensor string in a groove in said surface.

14. The method of claim 11, which includes the step of operably positioning said sensor string in a pipe in said surface.

* * * * *